United States Patent [19]

Ziehn

[11] 4,289,148

[45] Sep. 15, 1981

[54] PROCESS FOR IMPROVING THE FILLING CAPACITY OF TOBACCO

[76] Inventor: Klaus-Dieter Ziehn, Hunnenbarg 19, D-2080 Pinneberg, Fed. Rep. of Germany

[21] Appl. No.: 115,382

[22] Filed: Jan. 25, 1980

[30] Foreign Application Priority Data

Jan. 29, 1979 [DE] Fed. Rep. of Germany ..... 2903300

[51] Int. Cl.[3] ..... A24B 3/18

[52] U.S. Cl. ..... 131/291

[58] Field of Search ..... 131/140 P, 140 B

[56] References Cited

U.S. PATENT DOCUMENTS 1,789,435 1/1931 Hawkins ..... 131/140 P
2,344,106 3/1944 Reed ..... 131/140 P
2,739,599 3/1956 Abbott, Jr. ..... 131/140 P

FOREIGN PATENT DOCUMENTS 1331640 9/1973 United Kingdom ..... 131/140 P
1444309 7/1976 United Kingdom ..... 131/140 P

*Primary Examiner*—V. Millin
*Attorney, Agent, or Firm*—Cushman, Darby & Cushman

[57] ABSTRACT

The filling capacity of tobacco is improved by treating the tobacco with inert gas under pressure and subsequently heating after relieving the pressure. The tobacco is treated with nitrogen or argon at a working pressure between 300 and 1000 bar and working temperature in the range of 0° to 50° C. and after relieving the pressure then is treated briefly at a temperature of 100° to 400° C. or is subjected to microwave heating.

15 Claims, 1 Drawing Figure

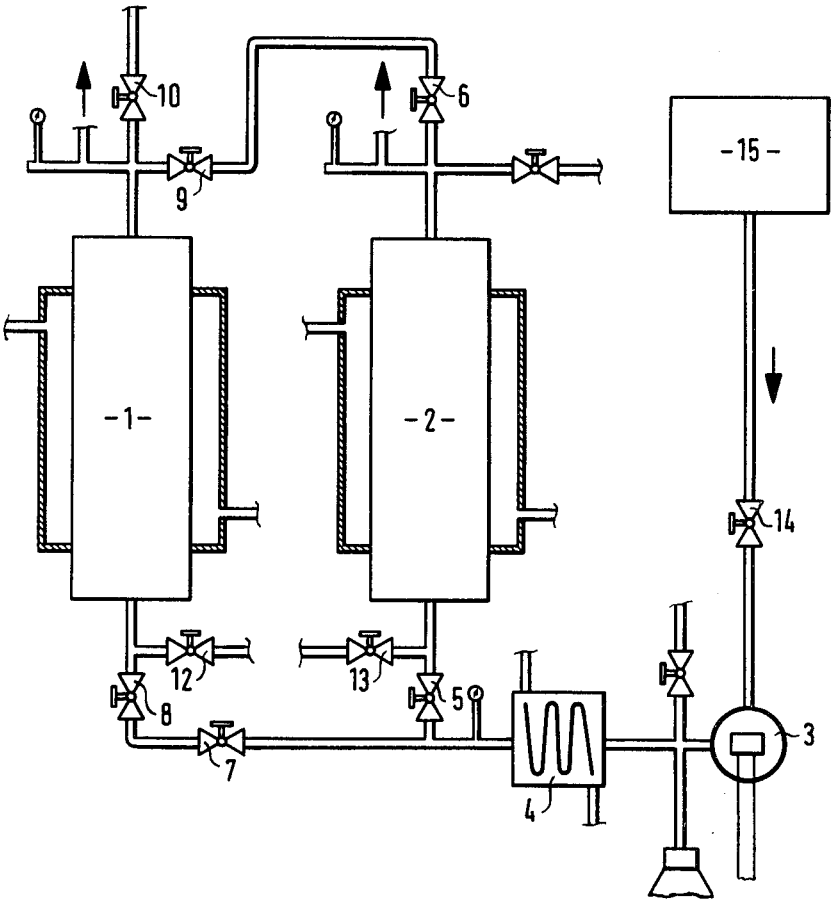
10
6
9
-15-
-1-
-2-
14
12
13
8
5
7
4
3

PROCESS FOR IMPROVING THE FILLING CAPACITY OF TOBACCO

BACKGROUND OF THE INVENTION

It is known to swell tobacco and subsequently subject it to heat-treatment in order to improve the filling capacity thereof.

Swelling processes with volatile organic compounds, e.g. according to U.S. Pat. No. 3,524,451 have the disadvantage that most organic solvents are unsuitable for use on an industrial scale due to their flammability. Halohydrocarbons also are unsuitable because they are prejudicial to the environment.

The swelling of tobacco with nitrous oxide according to U.S. Pat. No. 1,374,420 or with $SO_2$ according to U.S. Pat. No. 1,375,820 is also disadvantageous because, under certain conditions nitrous oxide can support combustion and is physiologically objectionable, while sulphur dioxide has strong reducing, bleaching and irritating properties.

The process of U.S. Pat. No. 3,778,533 proposes impregnating the tobacco with ammonia and carbon dioxide to make tobacco expand, but the ammonium carbonate which forms in situ can, under certain circumstances be left behind in the tobacco.

Finally, it is known, e.g. from U.S. Pat. No. 2,344,106 to use steam, air or $CO_2$ as swelling agents. However, steam and air have only a moderate swelling action, while there are objections to carbon dioxide in the case of basic tobaccos because an interaction is possible with the amine components of the tobacco.

In a process for improving the filling capacity, it is important not only to produce a volume increase, but also to retain the elasticity of the fibrous structure. Thus, although certain swelling agents bring about a considerable increase in the volume, the filling capacity is not improved if the cellular structure of the fibres is involved to such an extent that on further processing the tobacco crumbles or disintegrates to powder.

The problem of the invention is therefore to provide a process for improving the filling capacity of tobacco in which the taste acceptance of the tobacco is not impaired and in which the process can be performed in such a way that it is less costly from the apparatus and energy standpoints, can be performed in a much shorter time and is not prejudicial to the environment.

SUMMARY OF THE INVENTION

The invention is based on the surprising finding that strongly compressed nitrogen or argon in the range of 300 to 1000 bar constitutes an excellent swelling agent, so that the filling capacity of the tobacco can be greatly improved without impairing the fibrous structure. It is critical to use nitrogen or argon since air cannot be used at such high pressures because of the danger of an explosion.

According to the invention, this problem is solved by a process for improving the filling capacity of tobacco by treating the tobacco with inert gas under pressure and subsequent heating after relieving the pressure, characterized in that the tobacco is treated with nitrogen or argon at working pressures between 300 and 1000 bar and at working temperature in the range of 0° to 50° C. and after relief of the pressure, followed by brief treatment at a temperature of 100° to 300° C. or even to 400° C. or by microwave heating.

The post treatment or drying can be made practically with any usual apparatus such as drying chambers or drying tunnels which are heated with hot steam, hot air or hot gas or are heated externally; furthermore, a microwave or infrared heatint can be used.

When working with nitrogen the treatment is preferably made at pressures between 300 and 800 bar and when working with argon pressures in the range of 150 to 800 bar are preferred. The period of treating the tobacco is from 0.1 to 10 minutes and preferably 0.5 to 5 minutes. The time of treating the tobacco with nitrogen or argon has no substantial influence on the improvement of the filling capacity of the tobacco.

The release of pressure after the treatment period should be effected within a period of 0.5 to 10 and preferably within 0.5 to 3 minutes.

After the relief of pressure the post treatment at temperatures between 100° and 400° C. and preferably in a temperature range of 200° to 300° C. should be effected without undue delay which means that a transitory period of 1 to 10 minutes is most suitable with longer transitory periods the improvement of the filling capacity may be impaired.

The thermal post-treatment itself should be made within a relatively short period, namely within 0.5 to 10 minutes. The length of time for the thermal post treatment depends on the original humidity of the tobacco, the chosen temperature during treatment and to a lesser degree on the kind of tobacco being treated.

Furthermore, with respect to the improvement of the filling capacity it is recommended to control the humidity of the tobacco to be treated according to the invention and to provide a humidity which is above the value of the initial humidity of tobacco which normally is in a range between 10 and 15% by weight $H_2O$. This is effected by increasing the humidity in a manner as known per se e.g. to a range of about 20 to 25% by weight $H_2O$.

Generally it has been found that the time period during which the necessary pressure has been built up has nearly no influence on the improvement of the filling capacity while the period during which the pressure relief occurs tends to influence the filling capacity in the sense that a short time of pressure relief leads to a higher filling capacity.

Finally, it has been found that the filling capacity is generally increased proprotionally with the working pressure so that it may be also possible to treat the tobacco at working pressures above 1000 bar although this becomes uneconomical.

BRIEF DESCRIPTION OF THE DRAWINGS

The single FIGURE of the drawings is a diagramatic view of the apparatus for carrying out the process of the invention.

Hereinafter, the invention will be explained with the aid of the examples, in conjunction with the drawing.

Referring more specifically to the drawings:

The pressure vessel or reactor 1 is charged with the tobacco to be treated and is supplied with liquid nitrogen from storage tank 15 by means of a high pressure liquid gas pump 3 via the opened valves 7 and 8 after closing valves 5, 9, 10 and 12. The nitrogen is passed through a heat exchanger 4 in which the gas is brought to the desired temperature. After closing valve 7, tobacco is fed into container or reactor 2 and the latter is subsequently filled with nitrogen in the same way. At the end of the pressure relief of vessel 1, tobacco is removed and by means of the top line between valves 9 and 6 further charging with nitrogen takes place from reactor 2 to reactor 1. Any pressure difference which may exist is compensated by topping up with nitrogen from storage tank 15.

The filling capacity was determined in the conventional manner with a Borgwaldt densimeter using 7 grams of tobacco and the filling capacity improvement was calculated according to the following formula:

$$(P-V.100)/V=\%$$

in which P is the filling capacity of the sample and V the filling capacity of the control sample.

Untreated Virginia or Oriental tobacco with the same moisture content of approximately 11.0 or 11.5% was used for control purposes.

The process can comprise, consist essentially of or consist of the steps set forth with the materials disclosed.

DESCRIPTION OF THE PREFERRED EMBODIMENTS

EXAMPLES 1 to 4

Virginia tobacco was treated on the abovedescribed apparatus with nitrogen, the weight-in tobacco quantity in each case being 200 g and in addition in each case 10 grams of water was added. Treatment was performed at pressures and for a period of time as given in the following table 1, and at temperatures in the range of 30° to 35° C.; the period for pressure release was about 1.3 minutes. Immediately thereafter, the thus treated tobacco was treated thermally for a period of about 1 minute by leading the tobacco through a drying chamber at a temperature of 250° C.

The results given in the following table were obtained:

TABLE 1

| Example No. | Pressure (bar) | Action Time (Min) | Heat Treatment | Filling capacity improvement |
|---|---|---|---|---|
| 1 | 300 | 10 | 250°/1 min. | +34% |
| 2 | 800 | 10 | 250°/1 min. | +65% |
| 3 | 800 | 1 | 250°/1 min. | +62% |
| 4 | 800 | 10 | — | +27% |

The above values show a clear improvement to the filling capacity when working at higher pressure, as is apparent by comparing examples 1 and 2. A comparison of examples 2 and 4 shows the positive influence of the heat treatment, whereas the action time only has an insignificant influence, as is apparent from a comparison of examples 2 and 3.

EXAMPLE 5

The procedure of example 2 was repeated, but argon was used instead of nitrogen at a pressure of 800 bar, with an action time of 5 minutes, with a period of pressure release of about 1 minute with an immediately following heat treatment. The filling capacity improvement was 61 and 64%.

EXAMPLE 6

The procedure of example 2 was repeated but there were now used three different types of Virginia tabacco having a different humidity content. In the first test the tobacco had an initial humidity of 12% while the second test was made with tobacco the humidity of which had been increased to 20% $H_2O$, while the third type of tobacco had a humidity content of 30% $H_2O$. The improvement of the filling capacity was +37% in the first test, +68% in the second test and +62% in the third test. This shows that an additional increasing of humidity up to a certain value improves the filling capacity but that no further effect is achieved when the tobacco is too wet.

During further tests with oriental and Burleytobaccos corresponding results with respect to improvement of the filling capacity had been obtained.

What is claimed is:

1. In a process for improving the filling capacity of tobacco comprising treating the tobacco with gas under pressure and subsequent heating after relief of the pressure, the improvement comprising treating the tobacco with nitrogen or argon at a working pressure between 300 and 1000 bar and at a working temperature in the range 0° to 50° C. followed, after pressure relief, by brief treatment at a temperature of 100° to 400° C. or by microwave heating thereby improving the filling capacity of the tobacco.

2. A process according to claim 1 wherein the tobacco is treated with nitrogen at 500 to 800 bar and is then briefly heat-treated at 250° C.

3. A process according to claim 2 wherein a tobacco is treated whose moisture content has been increased before said treatment to a range of 20 to 25%.

4. A process according to claim 3 wherein the pressure relief is effected within 0.5 to 10 minutes.

5. A process according to claim 4 wherein the pressure relief is effected within 0.5 to 3 minutes.

6. A process according to claim 1 wherein the tobacco is treated at a temperature of 100° to 300° C. after the relief of pressure.

7. A process according to claim 1 wherein the heating is carried out by microwave heating after the relief of pressure.

8. A process according to claim 1 wherein the heating is carried out at 100° to 400° C. after the relief of pressure.

9. A process according to claim 8 wherein the heating is for 0.1 to 10 minutes.

10. A process according to claim 9 wherein the pressure of 300 to 1000 bar is applied for 0.5 to 10 minutes.

11. A process according to claim 1 wherein a tobacco is treated whose moisture content has been increased before said treatment to a range of 20 to 25%.

12. A process according to claim 11 wherein the tobacco is treated at a temperature of 100° to 400° C. after the relief of the pressure.

13. A process according to claim 12 wherein the heating is for 0.1 to 10 minutes.

14. A process according to claim 13 wherein the pressure relief is effected within 0.5 to 10 minutes.

15. A process according to claim 14 wherein the pressure relief is effected within 0.5 to 3 minutes.

* * * * *